US009422629B2

(12) United States Patent
Dyck et al.

(10) Patent No.: US 9,422,629 B2
(45) Date of Patent: Aug. 23, 2016

(54) METHOD OF TREATING ROLLED STEEL ARTICLE

(76) Inventors: John Wayne Dyck, Winnipeg (CA); Matthew Maris Mathews, Winnipeg (CA)

( * ) Notice: Subject to any disclaimer, the term of this patent is extended or adjusted under 35 U.S.C. 154(b) by 768 days.

(21) Appl. No.: 13/700,154

(22) PCT Filed: May 20, 2011

(86) PCT No.: PCT/CA2011/050316

§ 371 (c)(1), (2), (4) Date: Nov. 27, 2012

(87) PCT Pub. No.: WO2011/147037

PCT Pub. Date: Dec. 1, 2011

(65) Prior Publication Data

US 2013/0068249 A1 Mar. 21, 2013

Related U.S. Application Data

(60) Provisional application No. 61/348,924, filed on May 27, 2010.

(51) Int. Cl.

| | |
|---|---|
| ***C23G 1/02*** | (2006.01) |
| ***C23G 1/08*** | (2006.01) |
| ***C23G 1/00*** | (2006.01) |
| ***C23G 5/00*** | (2006.01) |
| ***C23G 5/02*** | (2006.01) |

(52) U.S. Cl.
CPC .. *C23G 1/08* (2013.01); *C23G 1/00* (2013.01); *C23G 5/00* (2013.01); *C23G 5/02* (2013.01)

(58) Field of Classification Search
None
See application file for complete search history.

(56) References Cited

FOREIGN PATENT DOCUMENTS

CA 2406647 A1 * 10/2002

* cited by examiner

*Primary Examiner* — Eric Golightly
(74) *Attorney, Agent, or Firm* — Ryan W. Dupuis; Kyle R. Salterthwaite; Ade & Company, Inc

(57) ABSTRACT

A method of treating a rolled steel article, the method comprising: providing a first solution comprising an acid arranged to separate mill scale components from steel and a surfactant arranged to suspend separated mill scale components in the first solution; applying the first solution to a surface of the article for a prescribed duration; rinsing the first solution from the surface of the article by applying a rinse liquid to the article; directing a first flow of air onto the surface of the article to remove moisture from the surface of rolled steel article; and directing a second flow of air onto the surface of the article subsequent to application of the second solution until remaining moisture on the article is substantially removed.

20 Claims, 2 Drawing Sheets

METHOD OF TREATING ROLLED STEEL ARTICLE

FIELD OF THE INVENTION

The present invention relates to treatment of a hot rolled or cold rolled steel article to remove mill scale, surface rust and oils prior to using the steel in the fabrication of a manufactured product. More particularly, this invention relates to the surface preparation of hot rolled steel and cold rolled steel articles to prepare them prior to fabricating processes including, but not limited to welding, laser cutting, coatings applications and transport of articles.

BACKGROUND

Hot and cold rolled steels are both used to fabricate a wide variety of goods, but each have unique properties depending on the temperature at which the steel has been worked or rolled in relation to the steel's critical temperature range, i.e., a temperature range through which the properties of the steel change dramatically. Hot rolled steel provided by steel mills is coated with a tough skin of steel oxide primarily composed of $Fe_3O_4$, known as "mill scale," whereas cold rolled steel has a smooth surface with very few blemishes. Hot rolled steel also has more rust that is tightly bound to the surface than does cold rolled steel. On the other hand cold rolled steel is normally "oiled" prior to shipment and said oils are desired to be removed prior to the welding, laser cutting and coatings processes.

The manufacturing/fabrication industry over the years has utilized both grit blast cleaning and pickling and oiling solutions to aid in the preparation of hot rolled steel for optimizing coatings adhesion. Blast cleaning has been found to be a flexible method of removing up to about 95 percent of the mill scale, it is nevertheless a high cost and maintenance-intensive surface preparation method. Not only does the abrasive itself have a limited life and high replacement cost, but grit blast cleaning also presents major safety concerns due to eye injuries and poses many serious operational problems. Such problems include rapid wear of mechanical moving parts due to fouling and contamination of lubricants, as well as part breakage due to abrasion and jamming. For example, there have been instances of shutdowns due to augers snapping upon being jammed with abrasive. Also, particle elevators have become jammed. Moreover, the presence of moisture is a problem with grit blast cleaning methods because the moisture causes the abrasive to agglomerate and form solid cakes, which are difficult to dislodge from the equipment, and can jam moving parts while compounding the problem of abrasive loss. Once the grit becomes caked, it then needs to be removed and replaced with new grit. There can be approximately forty to fifty-five 55-gallon drums to replace by hand, requiring about eight hours and three workers, and a loss of an entire production shift, in addition to the cost of the grit. Finally, the quality of finish attainable by grit blast cleaning is limited as a practical matter. In most commercial applications in which much of the mill scale is removed from metal surfaces, a significant amount of rust remains on hard-to-reach areas. Moreover, areas that are easily accessible are left with a 2-2.5 mil surface profile, which is an uneven surface requiring almost twice the amount of paint to coat. Operator inconsistencies regarding application of blasted grit can negatively impact both the end "profile" of the steel and thru heat, affect the steel's structural ability. Consequently, ever increasing input costs coupled with the manufacturers/fabricators desire to achieve optimum results paved the path for noted invention.

The Pickling and Oiling process demands large acquisition costs and input costs. Although the end result removes surface rust and mill scale—the end product the manufacturer/fabricator is left with is "oiled" steel to inhibit rusting of the surface for storage and transportation. Removal of the oils applied to the steel is required prior to the welding (smoke, splatter), laser cutting (piercing ability, diffusion and tip wear) and coatings (adhesion, corrosion assistants, fish eyes). This method resolves certain issues for the supplier of the steel, but still requires further processing by the manufacturer/fabricator—increasing overhead, input and labour costs. Also, certain coatings require a neutral ph on the substrate and pickling solutions have been noted to increase the acidity of the steel.

More particularly, there are a number of methods for cleaning iron and steel surfaces. Known methods include acid pickling, acid cleaning, alkaline descaling, salt bath descaling, brushing, and abrasive blasting or tumbling.

Other methods for surface cleaning and preparation include power tool cleaning, water washing, and abrasive injection in water. Power tool cleaning can remove a very high degree of rust and mill scale, but like blast cleaning, power tool cleaning generates large quantities of dust, while consuming large amounts of energy and requiring frequent maintenance and replacement of worn parts. Water washing equipment requires specialized components for operating at medium to high pressure (3000 psig or higher). For example, a pressure pump, a specialized lance and a nozzle assembly are required, in addition to large volumes of water. This technique can remove loose rust but will not effectively remove tight rust or mill scale. Abrasive injection in water may provide a greater ability to remove rust and mill scale. However, abrasive injection in water raises most of the concerns of ordinary blast cleaning, in addition to consuming large volumes of water.

Due to the drawbacks of these alternative methods, mill scale and rust on large articles made of hot rolled steel has conventionally been removed by blast cleaning, a method of removing mill scale, rust, rust scale, paint or foreign matter by the use of abrasives propelled through nozzles or by centrifugal wheels. Typically, a "Commercial Blast Cleaned Surface Finish" is sought, which is defined by the Steel Structures Painting Council (SSPC) as one from which all oil, grease, dirt, rust scale and foreign matter have been completely removed from the surface, and all rust, mill scale and old paint have been completely removed except for slight shadows, streaks, or discolorations caused by rust stain, mill scale oxides or slight, tight residues of paint or coating that may remain. If the surface is pitted, slight residues of rust or paint may be found in the bottom of pits. Under this definition, at least two-thirds of each square inch of surface area is free of all visible residues and the remainder is limited to the above-mentioned light discoloration, slight staining or tight residues.

SUMMARY OF THE INVENTION

According to one aspect of the invention there is provided a method of treating a rolled steel article, the method comprising:

providing a first solution comprising an acid arranged to separate mill scale components from steel and a surfactant arranged to suspend separated mill scale components in the first solution;

applying the first solution to a surface of the rolled steel article for a prescribed duration;

rinsing the first solution from the surface of the rolled steel article by applying a rinse liquid to the rolled steel article;

directing a first flow of air onto the surface of the rolled steel article to remove moisture from the surface of the rolled steel article;

providing a second solution which is more volatile than water;

applying the second solution to the surface of the rolled steel article; and directing a second flow of air onto the surface of the rolled steel article subsequent to application of the second solution until remaining moisture on the rolled steel article is substantially removed.

As described herein, the invention comprises an acid cleaning process that uses the first solution to not only release the mill scale and rust from the steel substrate but to suspend it from the surface allowing minimal psi and gpm to be deployed at the rinse stage, greatly decreasing input costs. The further steps in the process utilizing the second solution and air fully dehydrate the steel, inhibiting rust formation.

Preferably the surfactant comprises a non-anionic surfactant.

Preferably the first solution comprises a non-ionic, non-denaturing detergent, which may be a water conditioner and a non-butyl cleaner.

Preferably the first solution is applied to the rolled steel article at an ambient room temperature.

Preferably the prescribed duration of the first solution comprises approximately 3 to 10 minutes.

The first solution may be applied by dipping the rolled steel article into the first solution. Alternatively, the first solution may be applied by spraying the first solution onto exterior surfaces of the rolled steel article.

Preferably the second solution comprises an alcohol.

The second solution may be applied to the rolled steel article at an ambient room temperature by spraying the second solution as a mist onto exterior surfaces of the rolled steel article.

Preferably the rinse liquid comprises water.

The rinse liquid may be directed onto the rolled steel article in the form of a jet from a source of fluid under pressure which is less than 1000 psi.

Preferably the method includes directing the first solution, the rinse liquid, the first flow of air, the second solution, and the second flow of air at the rolled steel article at separate stations in a continuous flow process, navigating the rolled steel article through the separate stations in a working direction, and orienting the rinse liquid in a jet which is directed towards the rolled steel article at an inclination opposite to the working direction.

The method may further include directing the first solution, the rinse liquid, the first flow of air, the second solution, and the second flow of air at the rolled steel article at separate stations in a continuous flow process, navigating the rolled steel article through the separate stations in a working direction, and orienting the first and second flows of air towards the rolled steel article at an inclination opposite to the working direction.

Preferably the second flow of air is oriented to oppose the working direction more than the first flow of air. Also, preferably a larger volume of air is directed across a larger area of the article in the second flow of air than in the first flow of air.

Preferably the first and second flows of air are at ambient temperature.

Preferably the method includes applying the first solution, the rinse liquid, the first flow of air, the second solution, and the second flow of air to the rolled steel article in immediate succession with one another prior to fabricating the rolled steel article into a manufactured good.

The rolled steel article may comprise either a hot rolled steel article or a cold rolled steel article.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
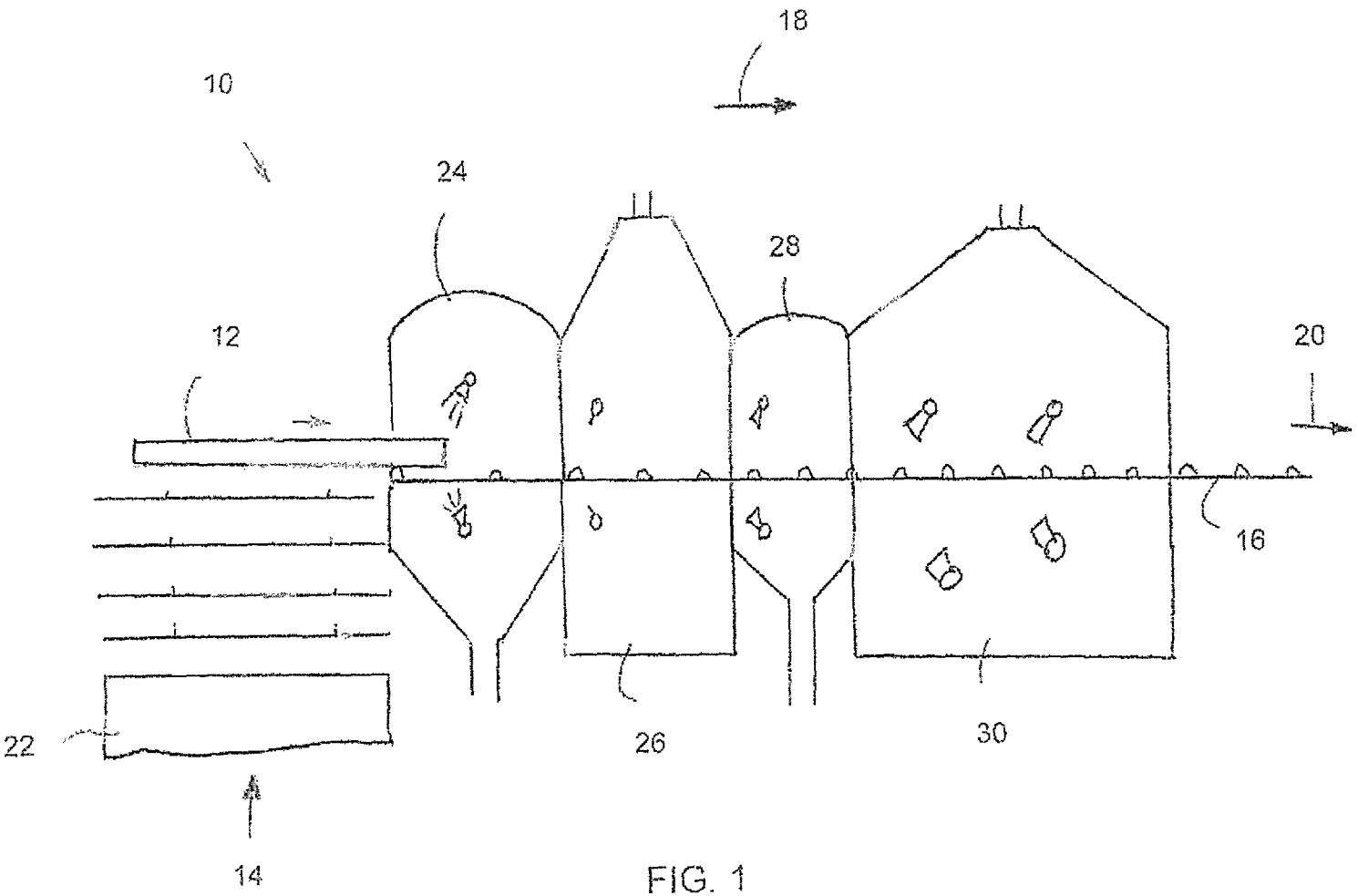
FIG. 1 is a schematic representation of the treatment system for treating a rolled steel article according to the present invention.

Referring to the accompanying figures there is illustrated a steel treatment system generally indicated by reference numeral 10. The system 10 provides a method of treating steel articles, for example hot rolled and cold rolled steel to prepare the steel prior to subsequent manufacturing and fabrication stages including cutting, welding, coating and the like.

The treatment method is a continuous flow process in which articles are navigated through a series of five stations in immediate succession with one another. The stations remain isolated from one another such that there is no cross contamination of fluids between adjacent stations. Articles 12 typically enter the system at an entrance 14 to be conveyed by a suitable conveying system 16 through the system in a forward working direction 18 to an outlet 20 of the system.

The first step in the process comprises applying a first solution to the outer surfaces of the rolled steel article 12 for a first prescribed duration. The first solution typically comprises a suitable acid, for example a hydrochloric acid, which is arranged to separate mill scale components from the surface of the steel. The first solution further comprises a surfactant which is arranged to suspend the separated mill scale components within the solution, as well as a suitable degreaser or detergent to remove oily residues from the steel. The additional components of the first solution optimize the cleansing ability of the first solution.

The first solution is applied at a first station 22 which may comprise a tank through which the steel article is dipped, or a chamber receiving the steel article therein so that the first solution can be sprayed onto the exterior surfaces of the article. In the latter instance, the first solution typically comprises a suitable thickener to allow the first solution to remain applied to the surface of the steel article for the required prescribed duration which is in the range of three to ten minutes in the preferred embodiment described below.

After the prescribed duration at the first station, the article is conveyed through a second station 24 for rinsing the first solution from the surface of the steel article. At the second station, a source of rinse liquid under pressure is directed through jets onto the surface of the steel article with the rinse liquid and first solution residues being collected from below the article. The source of rinse liquid under pressure is typically water at approximately 800 psi with the jets being directed through orifices as descried in further detail below. The jets are oriented towards the article at a rearward inclination opposite the forward working direction 18 such that the jets are oriented approximately 45 degrees from the travel direction, but in the opposing direction from the travel direction.

Upon exiting the second station, the article 12 passes through a third station 26 where a series of air knives direct non-heated air in a first flow onto the surface of the rolled steel article to remove substantially all visible moisture on the surfaces of the steel article. The jets are typically arranged such that the first flow of air therefrom is in a narrow sheet of moving air, for example having a thickness in the working direction which may be in the range of 0.5 to 1 inch while being elongate in a lateral direction across the width of the article. The first flow of air in the third station is also directed onto the article so as to be inclined rearwardly opposite the forward travel direction 18. In a preferred embodiment, the jets of air are directed at an orientation of approximately 45 degrees to the travel direction, but in an opposing direction to the travel direction.

Upon exiting the third station, the article 12 passes through the fourth station 28 where the second solution is applied to the surface of the rolled steel article. The second solution is applied in the form of a mist which is sprayed onto the surfaces of the article. The second solution typically comprises an alcohol, however any suitable liquid which is more volatile than water would be effective to assist in removing traces of moisture penetrated into the surface of the steel article. The second solution saturates the surface of the steel article for the prescribed duration that the steel article is conveyed through the fourth station until the article reaches the final and fifth station 30 for additional drying.

At the fifth station, a second flow of air is directed onto the surface of the steel article until substantially all remaining moisture on the rolled steel article is removed in a kiln drying process. The second flow of air also comprises non-heated air from a source of air under pressure directed onto the article in jets which are inclined rearwardly opposite the forward working direction. The airflows in the fifth station are typically oriented closer to 30 degrees from the travel direction as opposed to the first airflow which is closer to perpendicular to the travel direction than the second airflow. The second flows of air from the second jets are elongate in the lateral direction across the width of the article while also being many times thicker in the working direction than the first flow of air from the first jets. For example the air flow may be approximately 4 inches thick in the working direction so as to result in a greater movement of air for more thoroughly drying the article. The second airflow thus opposes the working direction more than the first flow. Furthermore the fifth station typically comprises a greater volume of air directed at the article than the second station to ensure a more thorough drying of the article at the completion of the treatment process.

Once the article 12 exits the outlet 20 of the treatment system, the article is ready for subsequent fabrication and manufacturing. The dry surface of the steel is also suitable for storage, handling and transport subsequent to treatment without concern for short-term corrosion re-emerging on the surface prior to subsequent fabrication and manufacturing processes.

As described herein, the cleaning and dehydrating stages are followed by at least one air movement stage. Thus, according to the present invention, the acid cleaning and dehydrating coating compositions are applied by a process comprising, in order:

1) Spraying or dipping the article(s) for a period of 3-10 minutes with solution 1. The first solution includes hydrochloric acid, a non-anionic surfactant, a non-ionic non-denaturing detergent, a water conditioner, and water ($H_20$).

2) Rinsing off solution #1 with pressurized water at defined angles, psi and gpm. For example the article is rinsed with water via 800 psi utilizing 0.017" orifice nozzles, both fixed and articulated depending on size or shape of article.

3) Removal of visible liquids off articles via pressurized air knives at defined angle, psi and cfm's to remove all visible moisture.

4) Misting and spraying solution #2 onto the article to rinse the article in which the second solution comprises a mixture of methanol and water.

5) Removal of non-visible liquids/moisture via motorized air blowers at defined angle, psi and cfm's. Accordingly the steel is fully dehydrated using motorized air fans at a described angle and cfm outputs.

This does not preclude the inclusion of additional intermediate stages such as, for example, additional rinse stages. In addition, one skilled in the art can appreciate that further benefits may be obtained by including additional stages for ancillary treatments such as sealing, phosphatising and primer application(s). Furthermore, the first and second flows of air for drying may comprise heated air for improving the results, however heated the air is not necessary and the cost of additional inputs may not justify the benefits of heating the air.

In order to achieve high quality cleaning and dehydration of the steel, while preventing cross-contamination of liquid to neighbouring stages in which liquid is also applied, the inventor has found it beneficial to substantially contain the mist, spray and fumes of each stage from carrying over to each of the other stages.

Hot rolled and cold rolled steel articles, comprising the various types ie. tube, square, rectangular, sheet and plate were tested.

Excellent results were achieved in a simulated commercial trial comprising five stages. Each stage is independent of each other. In each stage the optimum values regarding distance from the object, angle to the object, psi, gpm and cfm's of the liquids and air compromise the invention.

In the first stage, the steel articles have solution #1 either sprayed on or they are immersed in the solution. Either method requires a dwell time of 3-10 minutes, depending on the condition of the pre-processed surface. The time effect is directly related to the originating steel mill's abilities and roller process technology—that is the amount and consistency of the mill scale from the extrusion and forming process at the steel mill.

Through the use of solution #1 separation of the mill scale from the steel substrate was achieved, facilitated by the inclusion of the non-butyl cleaner within the solution. The effect allowed the mill scale to separate from the substrate allowing for minimal (800 psi) water pressure to extract all visible contaminants (mill scale, surface rust and oils). It was surmised that the dwell time was more important than the physical force with which the liquid jet stream was applied to the surface, minimizing input costs. It was found that whether thru immersing the articles for a period of 4 minutes, or via spraying with a line speed of 2 ft/minute, which ensured a dwell time of at least 4 minutes cleaning, provided excellent results.

The cleaning stage was followed by a water rinse stage, utilizing non-heated water. To maximize the effectiveness of the rinse and minimize the inputs required it was found the optimum configuration utilized 60 degree nozzle outputs coupled with a 0.017" orifice. This combination provided the maximum removal of the contaminants utilizing minimum inputs.

Stage three provides for "wiping" the moisture of the steel. Utilizing available air knife technologies positioned at a 45 degree angle from the article at a prescribed distance allowed the inventors to dehydrate the steel up to 95%, providing a surface conducive to "kiln drying" the surface as described in Stage Five.

The fourth stage, once all containments have been removed is, via a misting on of solution #2 to allow quicker removal of moisture from the steel. By utilizing solution #2 the time and effectiveness of the next air steps has been minimized and increased respectively.

Once the majority of moisture has been removed thru Stage three—Air Knifing the surface, and subsequently stage four's application of solution #2 for its evaporation qualities, it is further required to use non-heated air movement at a prescribed 30 degree angle from the article to extract all remaining moisture particles from the article. Once all tested articles finish this process, the end result is a steel surface devoid of containments, exposing a profile that exceeds all standard measurements for laser optimization, welding smoke reduction, hold, etc and increased coatings adhesion and corrosion wear.

Coating Adhesion Testing

A coating was applied to several steel samples which were prepared according to the treatment of the present invention as described above. The same coating was also applied under the same conditions to several steel samples which were prepared in a conventional manner by blasting with glass shot beads. The treated samples and the blasted samples where then tested for comparison.

More particularly, four steel samples were prepared by shot blasting and then coated. A testing element was adhered to coating. An average force of 1000 psi was required to release the testing element from the four steel samples which were shot blasted. On average 10% of the adhered contact area of the testing element resulted in a failure of the coating to adhere to the steel. A remainder of the contact area of the testing element became separated because of adhesive failure between the testing element and the coating.

Two more samples were prepared using the treatment of present invention prior to coating with the same coating under the same conditions as the above shot blasted samples. Also, a testing element of the same configuration as noted above was adhered to the coating using the same above noted adhesive applied under the same conditions as noted above. An average force of 1500 psi was required to be applied to the testing element to release the testing element from the two treated samples. On average only 5% of the adhered contact area of the testing element resulted in a failure of the coating to adhere to the steel. A remainder of the contact area of the tested element became separated because of adhesive failure between the testing element and the coating. The coating clearly adhered much better to samples treated according to the present invention than conventional shot blasted steel as a much greater pulling force resulted in less failure of the coating to adhere.

Figure 2A:
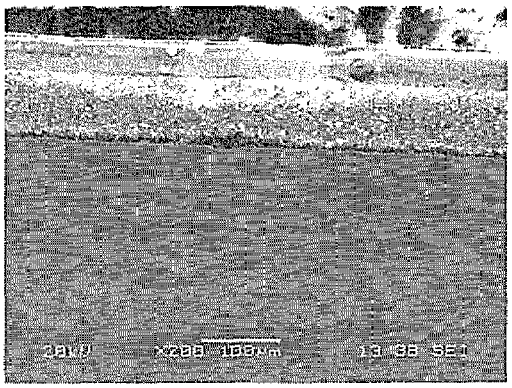
FIG. 2A is a photo of a profile of coated steel treated according to the present invention and magnified 200 times such that the overall sample size as shown is near 700 micrometers across.
Figure 2C:
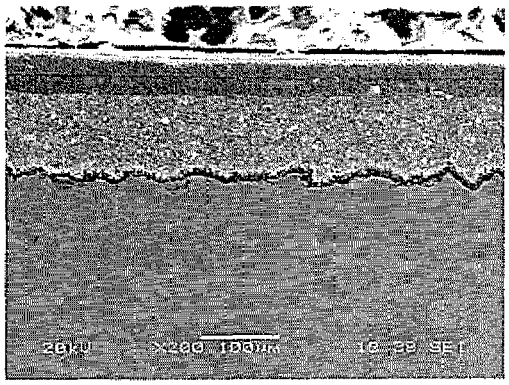
FIG. 2C is a photo of a profile of coated steel which was prepared by shot blasting and magnified 200 times such that the overall sample size as shown is near 700 micrometers across.
Figure 2B:
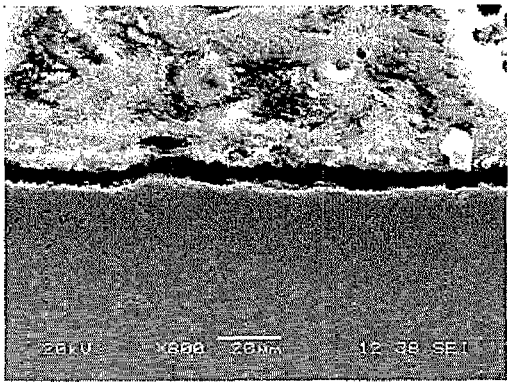
FIG. 2B is a photo of a profile of coated steel treated according to the present invention and magnified 800 times such that the overall sample size as shown is near 140 micrometers across.
Figure 2D:
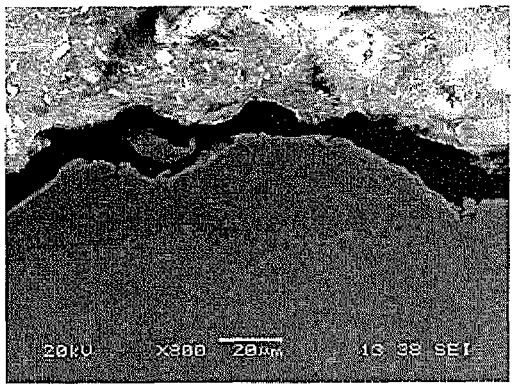
FIG. 2D is a photo of a profile of coated steel which was prepared by shot blasting and magnified 800 times such that the overall sample size as shown is near 140 micrometers across.

With further reference to the Figures, a cross section of one shot blast sample is shown in FIGS. 2C and 2D and a cross section of one treated sample according to the present invention is shown in FIGS. 2A and 2B for side by side comparison. In FIGS. 2A and 2C, both samples are shown magnified 200 times such that the overall sample size as shown is near 700 micrometers across. In FIGS. 2B and 2D, both samples are shown magnified 800 times such that the overall sample size as shown is closer to 140 micrometers across. As clearly shown in the sample, the protruding peaks at the surface of the treated steel are much smaller than the protruding peaks at the surface of the shot blasted steel. Accordingly, there are many more peaks per unit area in the treated steel than in the shot blasted steel. As each of the peaks contributes to the adherence of the coating applied thereto, the resulting surface profile of the steel treated according to the present invention is believed to contribute to the greater adhesion shown in the above noted coating adhesion test results.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of treating a rolled steel article, the method comprising:

providing a first solution comprising an acid arranged to separate mill scale components from steel and a surfactant arranged to suspend separated mill scale components in the first solution;

applying the first solution to a surface of the rolled steel article for a prescribed duration;

rinsing the first solution from the surface of the rolled steel article by applying a rinse liquid to the rolled steel article;

directing a first flow of air onto the surface of the rolled steel article to remove moisture from the surface of the rolled steel article;

providing a second solution which is more volatile than water;

applying the second solution to the surface of the rolled steel article; and directing a second flow of air onto the surface of the rolled steel article subsequent to application of the second solution until remaining moisture on the rolled steel article is substantially removed.

2. The method according to claim 1 wherein the surfactant comprises a non-anionic surfactant.

3. The method according to claim 1 wherein the first solution comprises a non-ionic, non-denaturing detergent.

4. The method according to claim 1 wherein the first solution comprises a water conditioner.

5. The method according to claim 1 wherein the first solution comprises a non-butyl cleaner.

6. The method according to claim 1 including applying the first solution to the rolled steel article at an ambient room temperature.

7. The method according to claim 1 wherein the prescribed duration of the first solution comprises approximately 3 to 10 minutes.

8. The method according to claim 1 including applying the first solution by dipping the rolled steel article into the first solution.

9. The method according to claim 1 including applying the first solution by spraying the first solution onto exterior surfaces of the rolled steel article.

10. The method according to claim 1 wherein the second solution comprises an alcohol.

11. The method according to claim 1 including applying the second solution to the rolled steel article at an ambient room temperature.

12. The method according to claim 1 including applying the second solution by spraying the second solution as a mist onto exterior surfaces of the rolled steel article.

13. The method according to claim 1 wherein the rinse liquid comprises water.

14. The method according to claim 1 including directing the rinse liquid onto the rolled steel article in the form of a jet from a source of fluid under pressure which is less than 1000 psi.

15. The method according to claim 1 including directing the first solution, the rinse liquid, the first flow of air, the second solution, and the second flow of air at the rolled steel article at separate stations in a continuous flow process, navigating the rolled steel article through the separate stations in a working direction, and orienting the rinse liquid in a jet which is directed towards the rolled steel article at an inclination opposite to the working direction.

16. The method according to claim 1 including directing the first solution, the rinse liquid, the first flow of air, the second solution, and the second flow of air at the rolled steel article at separate stations in a continuous flow process, navigating the rolled steel article through the separate stations in a working direction, and orienting the first and second flows of air towards the rolled steel article at an inclination opposite to the working direction.

17. The method according to claim 1 including orienting the second flow of air to oppose the working direction more than the first flow of air.

18. The method according to claim 16 including directing a larger volume of air across a larger area of the article in the second flow of air than in the first flow of air.

19. The method according to claim 1 wherein the first and second flows of air are at ambient temperature.

20. The method according to claim 1 including applying the first solution, the rinse liquid, the first flow of air, the second solution, and the second flow of air to the rolled steel article in immediate succession with one another prior to fabricating the rolled steel article into a manufactured good.

* * * * *